US009388716B2

(12) United States Patent
Smolenski et al.

(10) Patent No.: US 9,388,716 B2
(45) Date of Patent: Jul. 12, 2016

(54) SYSTEMS AND METHODS FOR ACCURATELY COMPENSATING FOR A CHANGE IN AMOUNT OF UNWANTED FLUID DILUTED IN ENGINE OIL RESULTING FROM A RECENT LONG TRIP

(75) Inventors: Donald John Smolenski, Grosse Pointe, MI (US); Eric W. Schneider, Shelby Township, MI (US); Daniel Hicks Blossfeld, Novi, MI (US); Matthew J. Snider, Howell, MI (US); Eric R. Johnson, Brighton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 732 days.

(21) Appl. No.: 13/528,134

(22) Filed: Jun. 20, 2012

(65) Prior Publication Data

US 2013/0345925 A1 Dec. 26, 2013

(51) Int. Cl.
*F01M 11/10* (2006.01)

(52) U.S. Cl.
CPC ..... *F01M 11/10* (2013.01); *F01M 2011/14* (2013.01); *F01M 2011/146* (2013.01); *F01M 2011/148* (2013.01); *F01M 2011/1473* (2013.01); *F01M 2011/1486* (2013.01)

(58) Field of Classification Search
CPC ..... F01M 11/10
USPC ..... 702/176
See application file for complete search history.

(56) References Cited

U.S. PATENT DOCUMENTS

| | | | | |
|---|---|---|---|---|
| 4,438,497 | A * | 3/1984 | Willis et al. | 701/105 |
| 4,506,337 | A * | 3/1985 | Yasuhara | 701/29.5 |
| 5,170,868 | A * | 12/1992 | Yamashita | F16D 48/066 192/82 T |
| 6,327,900 | B1 * | 12/2001 | Mc Donald | F01M 1/18 701/29.5 |
| 8,818,570 | B2 * | 8/2014 | Johnson et al. | 701/2 |

* cited by examiner

*Primary Examiner* — Bryan Bui
(74) *Attorney, Agent, or Firm* — Parks IP Law LLC; Mickki D. Murray, Esq.

(57) ABSTRACT

A system, for use in accounting for an effect of a long-trip cycle on remaining life of engine oil, being used in a vehicle, using a long-trip rebate value. The system includes a computer processor and a non-transitory computer-readable medium that is in operative communication with the processor and has instructions that, when executed by the processor, cause the processor to perform various operations. The operations include determining a long-trip time indicating an amount of time that the vehicle was operated recently in the long-trip cycle. The operations further include determining the long-trip rebate according to a rebate function using the determined long-trip time.

20 Claims, 8 Drawing Sheets

SYSTEMS AND METHODS FOR ACCURATELY COMPENSATING FOR A CHANGE IN AMOUNT OF UNWANTED FLUID DILUTED IN ENGINE OIL RESULTING FROM A RECENT LONG TRIP

TECHNICAL FIELD

The present disclosure relates generally to systems and methods for accurately estimating a level of dilution of at least one unwanted fluid in engine oil and, more particularly, to systems and methods for better estimating dilution of one or more fluids, such as fuel and water, into the engine oil of a vehicle being used for short trips, by accounting for beneficial effects of occasional longer trips.

BACKGROUND

Some modern automobiles have engine oil monitoring systems. These systems provide the user or technician with an indication of when an oil change is needed. The indication is typically provided by illuminating a light or presenting a message to the customer when the system determines that it is time to change the oil.

The engine oil monitoring systems make determinations related to oil life based on variables such as an amount of time, or miles driven, since a last oil change, with the assumption that the oil degrades by an average amount with time and miles. Estimating degradation based on time and/or miles alone has inherent inaccuracies because the degradation depends on many other factors including a quality or health of the engine in which the oil is used, ambient temperature in which the vehicle is being used (e.g., winter-like temperatures as compared to spring or summer-type temperatures), and a type of driving that the car has been used for. Regarding the latter, oil will degrade differently, and generally at an overall higher rate, in a car driven mostly or completely in stop-and-go, or city, driving, than in the same car used mostly for highway driving.

One option for obtaining a better estimate of oil degradation is to analyze the oil to determine a present value of multiple key oil properties. This analysis, though, would require adding relevant sensors, corresponding software, and possibly additional hardware beyond the new sensors to the vehicle, requiring more packaging space for the engine oil life processes and adding weight and cost to the vehicle.

There is a need for technology that can better estimate oil degradation by considering dilution of the oil by one or more unwanted fluids, such as fuel and water, and more particularly to the healing effect that occasional longer trips have on the unwanted dilution.

SUMMARY

The present disclosure in one aspect relates to a system, for use in accounting for an effect of a long-trip cycle on remaining life of engine oil, being used in a vehicle, using a long-trip rebate value. The system includes a computer processor and a non-transitory computer-readable medium that is in operative communication with the processor and has instructions that, when executed by the processor, cause the processor to perform various operations. The operations include determining a long-trip time indicating an amount of time that the vehicle was operated recently in the long-trip cycle. The operations further include determining the long-trip rebate according to a rebate function using the determined long-trip time.

In another aspect, the present disclosure relates to a method performed by a computer processor executing computer-executable instructions. The method is performed at least in part to account for an effect of a long-trip cycle on remaining life of engine oil, being used in a vehicle, using a long-trip rebate value. The method includes determining a long-trip time indicating an amount of time that the vehicle was operated recently in the long-trip cycle. The method further includes determining the long-trip rebate according to a rebate function using the determined long-trip time.

In still another aspect, the present disclosure relates to a non-transitory computer-readable medium having instructions that, when executed by the processor, cause the processor to perform various operations. The operations include determining a long-trip time indicating an amount of time that the vehicle was operated recently in the long-trip cycle. The operations further include determining the long-trip rebate according to a rebate function using the determined long-trip time.

Other aspects of the present invention will be in part apparent and in part pointed out hereinafter.

DETAILED DESCRIPTION

Figure 1:
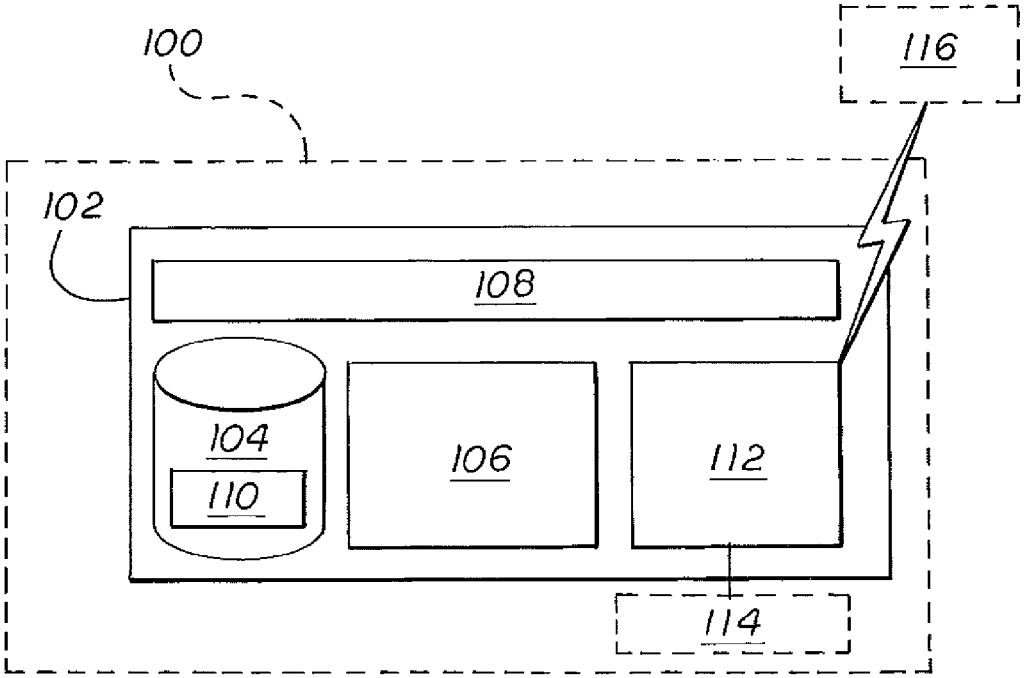
FIG. 1 illustrates a schematic block diagram of a system for implementing the present technology.

As required, detailed embodiments of the present disclosure are disclosed herein. The disclosed embodiments are merely examples that may be embodied in various and alternative forms, and combinations thereof. As used herein, for example, "exemplary," and similar terms, refer expansively to embodiments that serve as an illustration, specimen, model or pattern.

The figures are not necessarily to scale and some features may be exaggerated or minimized, such as to show details of particular components. In some instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to employ the present disclosure.

For efficiency of description and readability, the present disclosure describes the systems and methods of the present technology primarily in connection with engine oil used in automobiles. The technology of the present disclosure, though, is not limited to use in connection with automobiles and can be used in connection with oil of any type of vehicle, such as aircraft and watercraft.

Overview of the Disclosure

Engine oil life systems calculate oil life much more effectively than the standard method of using fixed oil change intervals. Changing oil every at such an interval, such as every 12 weeks, regardless of particular circumstances for the vehicle, result in the oil having much less or much more useful life at the end of the interval.

An improvement to past engine oil life systems is use of a basic penalty factor in calculating remaining engine oil life. The penalty factor is assigned in the algorithm as a function of oil temperature, increasing as oil temperature decreases. The penalty factor is an attempt to account for unwanted contaminants in the oil, such as unburned fuel concentrating in the engine oil during low-temperature operation. In use, the penalty factor operates to shorten oil life from a life that the system would estimate without the penalty factor to accommodate for the contamination, e.g., for the amount of unburned fuel believed to be in the oil.

For additional information regarding penalty factors, reference is made to U.S. Pat. No. 6,327,900 of General Motors®.

While systems using the basic penalty factor provide more accurate estimates of remaining oil life than earlier methods, further accuracy is obtainable. System using basic penalties factors estimate life accurately for consistently low-temperature operation (e.g., all or mostly all city driving), but does not account for a healing effect of common or at least occasional longer trips. During the longer trips, the engine oil becomes fully-warmed. When the oil reaches at least a normal operating temperature, contaminants including at least fuel and water in the engine oil will begin to vaporize gradually. Because fuel (e.g., gasoline) has various hydrocarbons and a relatively wide boiling range, the amount of fuel vaporized out of the oil is dependent on the time the temperature is at the higher temperatures.

A further-improved algorithm, thus, accounts for this healing effect of longer trips by adjusting the penalty factor to account for an estimated amount of fuel and/or water removal at higher temperatures. This adjustment is made in response to a determination that an uninterrupted operation time of the vehicle has extended above a predetermined threshold separating what is considered a short trip from what is considered a long trip. The improved algorithm results in a more accurate estimate of fuel and/or water dilution, especially in connection with low-temperature, short-trip, operation with occasional high-temperature, longer-trip operation.

A benefit of accounting for this healing effect is that effective intervals calculated in the engine oil life system for changing the oil are extended.

The present disclosure describes first accounting for the healing effect that longer trips have by dissipation (e.g., vaporization) of unwanted fuel in the oil. The disclosure then turns to describing the similar healing effect with respect to dissipation (e.g., evaporation) of unwanted water in the oil. While these embodiments are provided separately, it will be appreciated that the embodiments can be, and in some implementations are preferably, used together. In one aspect of the present technology, the algorithm described below in connection with accounting for the healing effect that longer trips have by vaporization of unwanted fuel can be used in the vehicle at same time that the algorithm described below in connection with accounting for the healing effect that longer trips have by evaporating of unwanted water. In one aspect of the present technology, a single algorithm incorporates some or all aspects of both of the separately described algorithms. One or more of any features or functions that are common between the algorithms described below (e.g., the vehicle and/or ECU on acts 402 and 902 described below in connection with FIGS. 4 and 9, respectively) can be shared—e.g., performed once with respect to the fuel and to the water calculations).

Due to the common features, and fuel and water being example contaminants, at times herein, including in the claims, one or more contaminants may be described more generally, such a fluid. The contaminant, whether fuel, water, and/or other, could also be referred to simply as a contaminant, a contaminating material, element, or fluid, or the like.

For efficiency of description and readability, the present disclosure describes the systems and methods of the present technology primarily in connection with engine oil used in automobiles. The technology of the present disclosure, though, is not limited to use in connection with automobiles and can be used in connection with oil of any type of vehicle, such as aircraft and watercraft.

FIG. 1

Now turning to the figures, and more particularly to the first figure, FIG. 1 illustrates a schematic block diagram of a system 100 for implementing functions of the present technology. The system 100 is in some embodiments implemented as a computer for use in analyzing oil of a vehicle, such as an automobile. The system 100 can be remote to the vehicle, a part of the vehicle, and/or the vehicle, itself.

As shown in FIG. 1, the system 100 includes a computing unit 102. For embodiments in which the system 100 is associated with (e.g., includes, is, or is part of a vehicle), the computing unit 102 could be associated with an onboard computer unit (OCU). Alternatively or in addition, the computing unit 102 can also be associated with an electronic control module (ECM), such as an ECM designed to monitor and/or control use of engine oil.

The computing unit 102 includes a memory, or computer-readable medium 104, such as volatile medium, non-volatile medium, removable medium, and non-removable medium. The term computer-readable media and variants thereof, as used in the specification and claims, refer to tangible, non-transitory, storage media.

In some embodiments, storage media includes volatile and/or non-volatile, removable, and/or non-removable media, such as, for example, random access memory (RAM), read-only memory (ROM), electrically erasable programmable read-only memory (EEPROM), solid state memory or other memory technology, CD ROM, DVD, BLU-RAY, or other optical disk storage, magnetic tape, magnetic disk storage or other magnetic storage devices.

The computing unit 102 also includes a computer processor 106 connected or connectable to the computer-readable medium 104 by way of a communication link 108, such as a computer bus.

The computer-readable medium 104 includes computer-executable instructions 110. The computer-executable instructions 110 are executable by the processor 106 to cause the processor, and thus the computing unit 102, to perform any one or combination of the functions described herein. These functions are described, in part, below in connection with FIG. 2.

The computer-executable instructions 110 can be arranged in one or more software modules. The modules can be referred to by the act or acts that they cause the processor 106 to perform. For instance, a module including instructions that, when executed by the processor 106, cause the processor to perform a step of determining particular data can be referred to as an determining module. Similarly, a module causing the processor to calculate a value can be referred to as a calculating module, a calculation module, or the like.

The term software module, or variants thereof, is used expansively herein to include routines, program modules, programs, components, data structures, algorithms, and the like. Software modules can be implemented on various system configurations, including servers, network systems, single-processor or multiprocessor systems, minicomputers, mainframe computers, personal computers, hand-held computing devices, mobile devices, microprocessor-based, programmable consumer electronics, combinations thereof, and the like.

The processor 106 is also connected or connectable to at least one interface 112 for facilitating communications between the computing unit 102 and extra-unit devices 114/116. For embodiments in which the system 100 is remote to the vehicle, the remote device 116, with which the system 100 can communicate via the interface 112, can include the vehicle. For embodiments in which the system 100 is associated with the vehicle, the interface 112 can connect the computing unit 102 to other vehicle components 114 and/or remote devices 116.

In various embodiments, whether the system 100 is a part of the vehicle, the device 116 can include, for instance, nodes remote to the system 110, such as another computer, a removable storage device (e.g., flash drive), a near-field wireless device, or remote device accessible by way of a long-range communications network (e.g., a cellular or satellite network).

For short-range wireless communications, the interface, instructions, and processor are configured to use one or more short-range communication protocols, such as WI-FI®, BLUETOOTH®, infrared, infrared data association (IRDA), near field communications (NFC), Dedicated Short-Range Communications (DSRC), the like, and improvements thereof (WI-FI is a registered trademark of WI-FI Alliance, of Austin, Tex., and BLUETOOTH is a registered trademark of Bluetooth SIG, Inc., of Bellevue, Wash.).

In a contemplated embodiment, whether the system 100 is a part of the vehicle, the external device 116 includes one or more devices of a remote processing and monitoring system such as the OnStar® monitoring system of the General Motors Company. The OnStar® system provides numerous services including remote-diagnostics and in-vehicle safety and security. In one embodiment, the computing unit 102, itself, is a part of a remote processing system, such as OnStar®.

Although shown as being a part of the computing unit 102, completely, the interface 112, or any aspect(s) thereof, is in some embodiments partially or completely a part of the computing unit 102. The interface 112, or any aspect(s) thereof, can be partially or completely external to and connected or connectable to the computing unit 102. For communicating with the external device(s) 116, the interface 112 includes one or both of a short-range transceiver and a long-range transceiver.

The device(s) 114/116, internal or external to the computing unit 102, can include any of various devices acting as inputs and/or outputs for the unit 102. For at least some embodiments in which the device 114 includes one or more vehicle components 112, the device 114 includes at least one sensor configured to sense at least one property or characteristic of engine oil in the vehicle. Sensors 114 used by the computing unit 102 may also be used by an engine oil life system, such as the Engine Oil Life System (EOLS) of General Motors®.

Such sensors 114 can include one or more of (i) a viscosity sensor (e.g., viscometer), for measuring a level of oil viscosity of the engine oil, (ii) an oxidation sensor for measuring a level of oxidation of the engine oil (which can be indicated as Diff-Oxidation), (iii) a nitration sensor for measuring a level of nitration of the engine oil (or Diff-Nitration), and (iv) a TAN sensor for determining a total acid number for the oil, such as by titration—e.g., a potentiometric titration or color indicating titration sensor. Other sensors 114 that could be used by the computing unit 102 include (v) a water-contamination sensor for measuring an amount (e.g., percentage or units) of water dilution, or contamination, of the oil, (vi) an engine oil level sensor, (vii) a fuel-contamination sensor for measuring an amount of fuel (e.g., gasoline) dilution, or contamination, of the oil, (viii) an engine oil temperature sensor, and (ix) an electrochemical oil quality sensor, for measuring an electro-chemical characteristic of the engine oil.

In some embodiments the sensors 114 also include those associated with measuring travel distance (e.g., mileage) of the vehicle. Such sensors include an odometer, or other devices for providing data related to an amount of vehicle travel, such as wheel sensors or parts of a global-positioning system.

Other example sensors 114 are those measuring engine conditions, such as real-time performance. In some embodiments, these sensors include those measuring engine combustion activity, such as a number of combustion events per unit time (e.g., per minute, hour, day, etc.).

In a contemplated embodiment, a single sensor performs two or more of the sensing functions described herein.

In some embodiments, the in-vehicle extra-unit devices 114 include a vehicle-user interface (VUI). The VUI facilitates user input to the vehicle and/or output from the vehicle to the user. An example VUI, is a visual display, such as a dashboard, overhead, or head-up display. The display could be a part of an instrument panel also including readouts for speed, engine temperature, etc. The display in some cases includes one or more light-emitting diodes (LEDs) or other lighting parts. Another example output device is a speaker for providing audible messages to the customer. The audible messages can be verbal (e.g., "An oil change is recommended") or non-verbal, such as a tone, beep, ring, buzz, or the like. The computing unit 102 is in some embodiments configured to provide both audible and visual communications to the customer, via an output device 114 such as substantially simultaneously in connection with the same event (e.g., upon determination that an oil change is needed).

As examples of input devices, or input aspect of an input/output device, the described display can include a touch-sensitive screen, and the vehicle can include a microphone, for receiving input from the user (e.g., instructions, settings or preference information, etc.).

Healing Effect on Oil Via Reduced Fuel Contamination

FIG. 2

Figure 2:
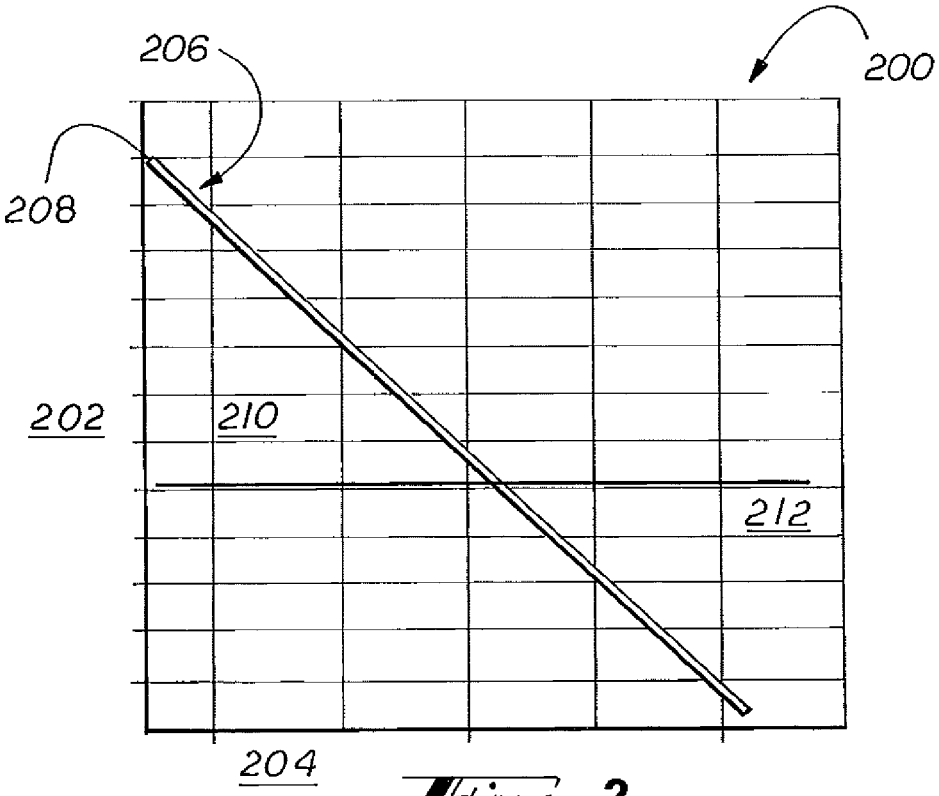
FIG. 2 illustrates a chart showing fuel dilution per revolution as a function of oil temperature, according to one example.

With continued reference to the figures, FIG. 2 illustrates a chart 200 showing fuel dilution per revolution (FR) 202 (or rate of fuel dilution) as a function of oil temperature 204, according to one example. Exemplary actual values for fuel dilution per revolution (FR) 206 are shown.

In the illustrated embodiment, the actual value for fuel dilution per revolution (FR) is highest at a start of vehicle operation ($FR_{initial}$, or $FR_{max.}$), when the temperature is lowest ($T_{initial}$, or $T_{min.}$). In one embodiment, as shown in FIG. 2, the fuel dilution per revolution decreases in generally a linear manner with increase in temperature, such as from the initial, or maximum, fuel dilution per revolution ($FR_{initial}$, or $T_{max.}$) to a final or minimum fuel dilution per revolution ($FR_{final}$, or $T_{min.}$).

The chart 200 also illustrates a transition point 208, corresponding to a transition oil temperature (T) 204. Below the transition temperature, fuel is generally being added to the oil during vehicle operation, and above the transition temperature, fuel is generally being evaporated from the oil during operation.

FIG. 3

Figure 3:
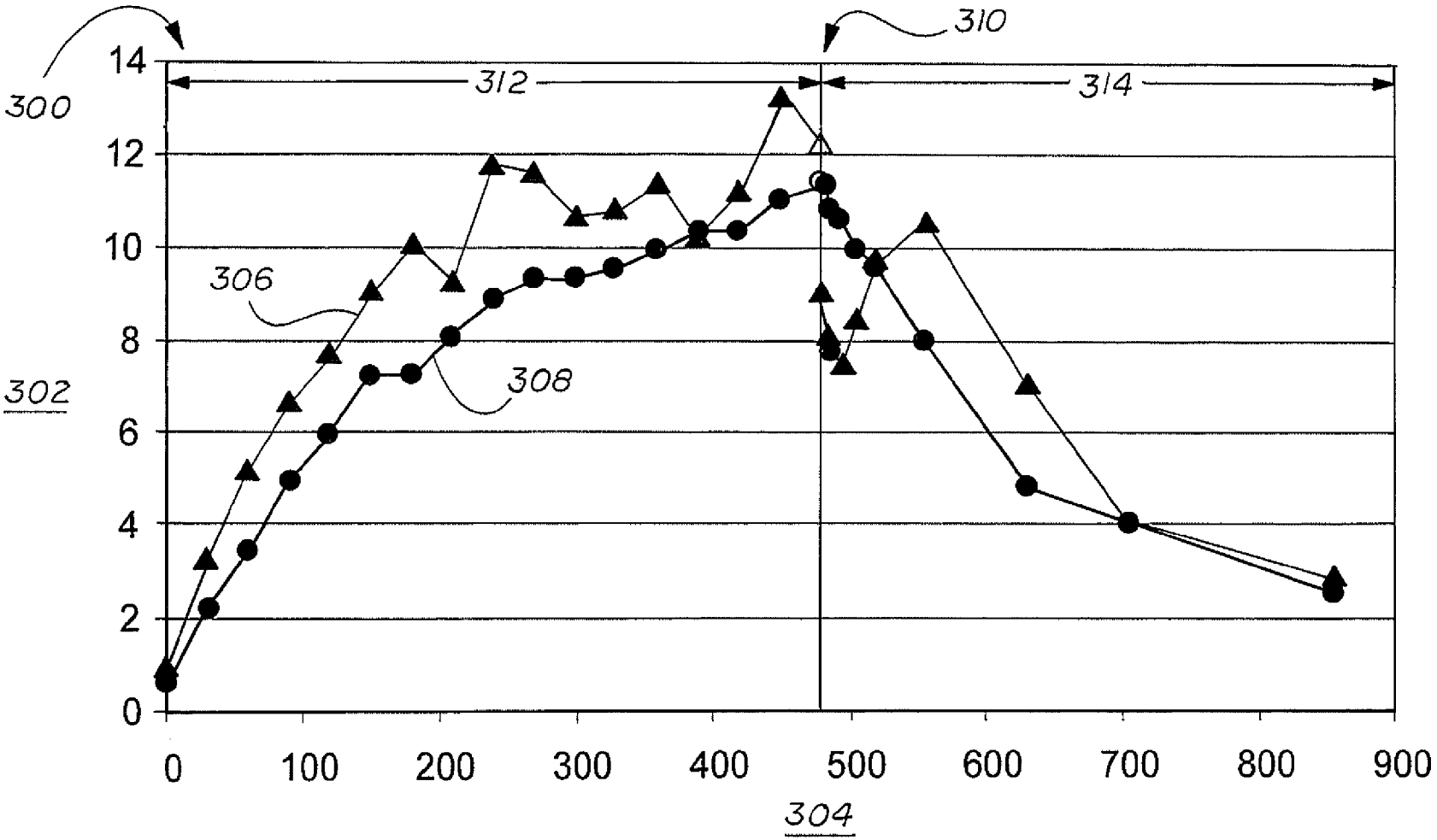
FIG. 3 illustrates a chart showing a percentage of fuel weight in an oil sample as a function of miles driven, according to one example.

FIG. 3 illustrates a chart 300 showing a percentage of fuel weight 302 in an oil sample as a function of miles 304 driven by a vehicle in cooler (e.g., winter time of year) temperatures 306, and in warmer (e.g., spring) temperatures 308. As shown in the chart 300, when used in the cooler temperatures, the oil has higher percentages of fuel weight as compared to the oil when the vehicle is operating in the warmer ambient environment. Operation up to a certain, transition mileage 310 (e.g., about 4 miles in one embodiment) can be referred to as a short-trip driving cycle 312, and above that mileage 310, a long-trip, or highway driving cycle 314.

As shown in the figure, in the short-trip driving cycle 312, the percentage of fuel weight 302, for both cooler and warmer-environment driving, generally increases with the number of short trips. Following the transition mileage 310, the percentage of fuel weight 302 generally decreases as vehicle enters and continues operating in the long-trip cycle 314.

Figure 4:
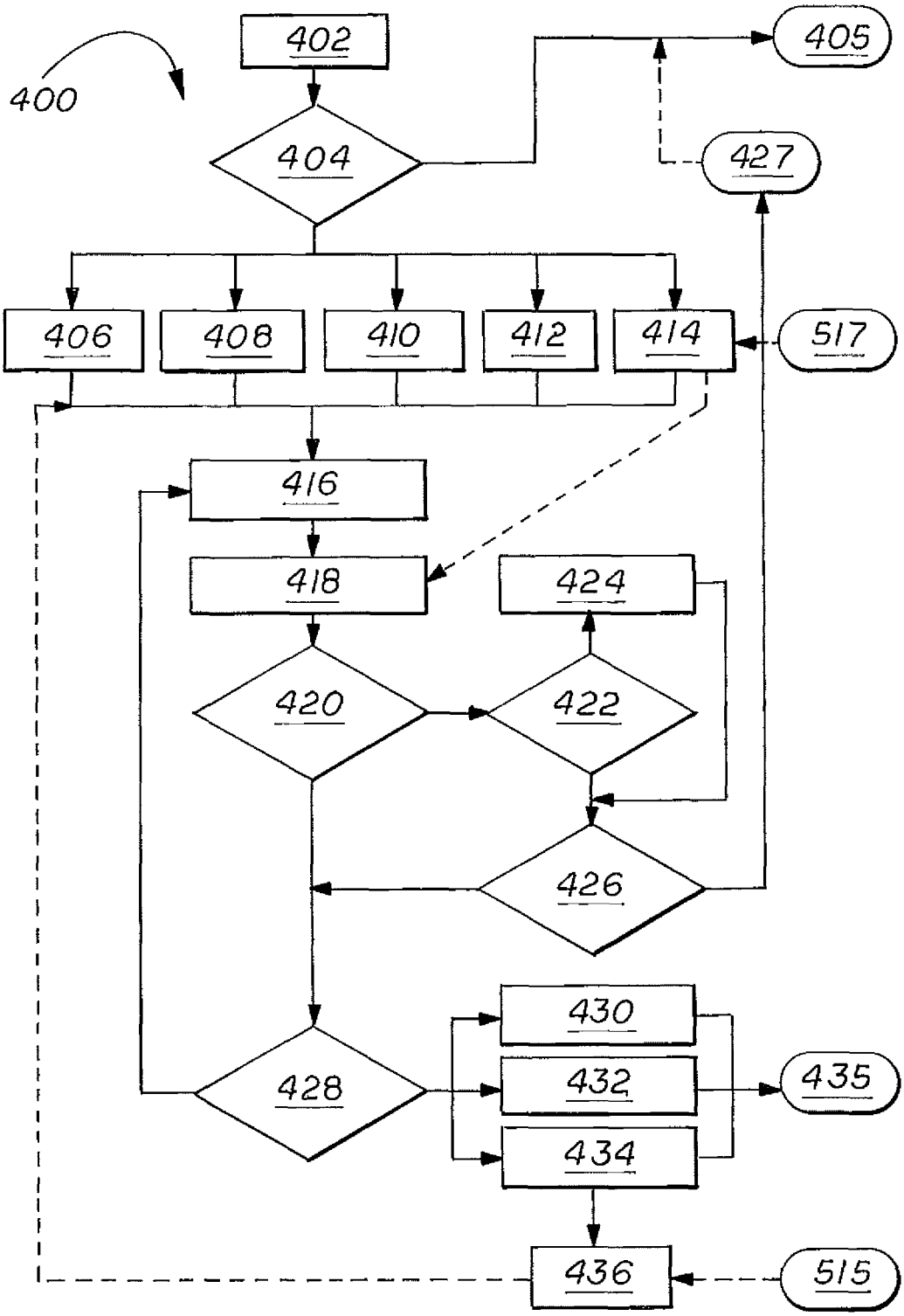
FIG. 4 illustrates initial aspects of a method for estimating degradation of engine oil, with consideration given to fuel dilution of the oil and the healing effect of occasional longer trips.
Figure 5:
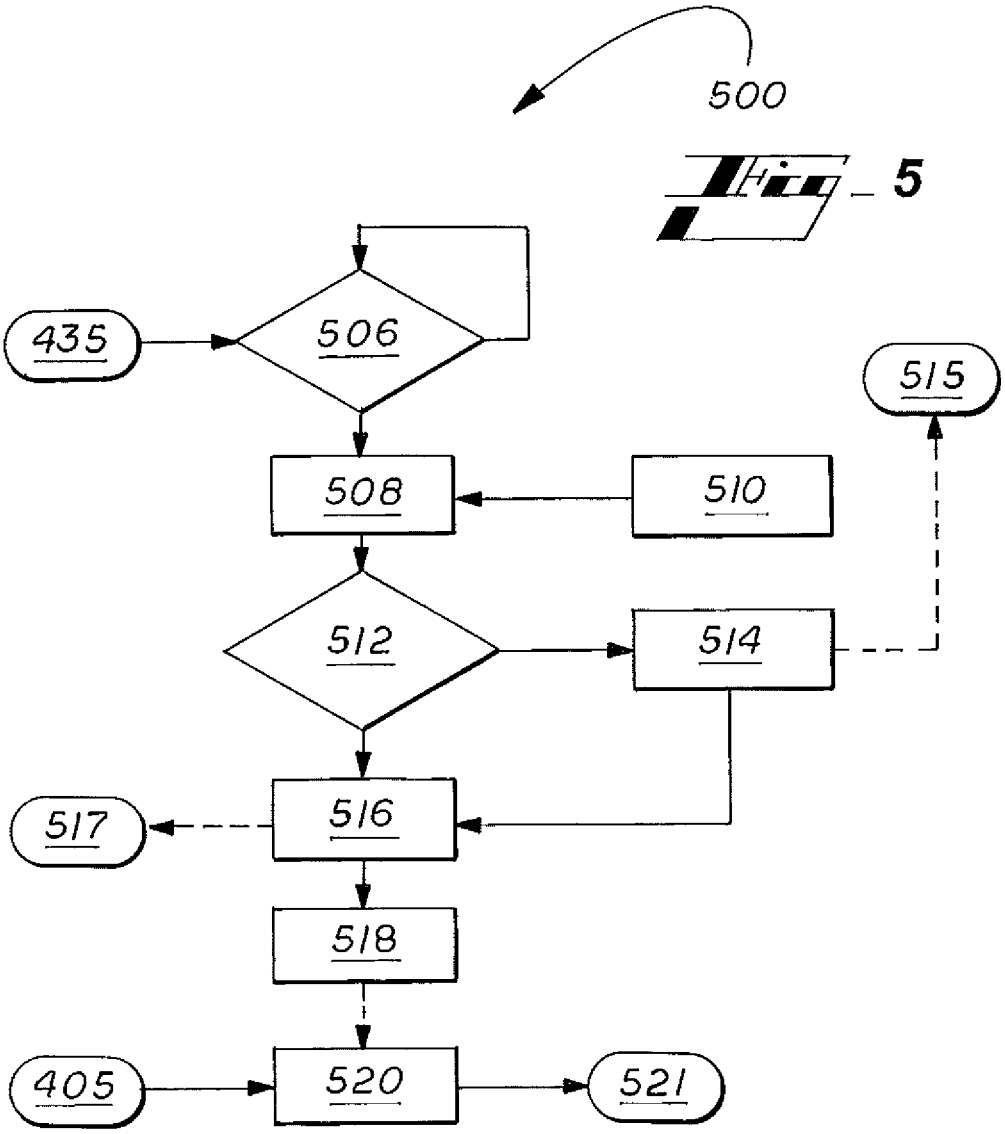
FIG. 5 illustrates other aspects of the method described in connection with FIGS. 4 and 6.
Figure 6:
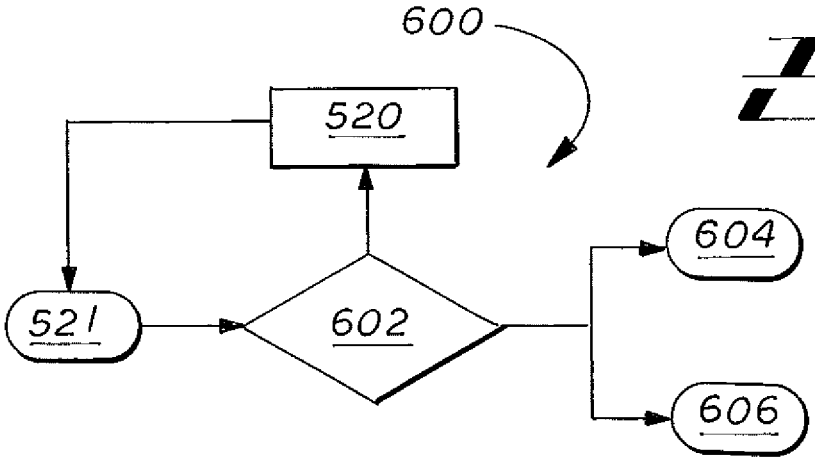
FIG. 6 illustrates additional aspects of the method described in connection with FIGS. 4 and 5.

Introduction to FIGS. 4-6

FIGS. 4-6 illustrate schematically an exemplary method for estimating degradation of engine oil, with consideration to fuel dilution of the oil and a healing effect of at least occasional long-trip driving. Each figure of FIGS. 4-6 can be considered to show a sub-method (sub-methods 400, 500, 600) of the overall method shown by the figures taken together.

The steps of the method shown by FIGS. 4-6 described herein are not necessarily presented in any particular order and that performance of some or all the steps in an alternative order is possible and is contemplated. The steps have been presented in the demonstrated order for ease of description and illustration. Steps can be added, omitted and/or performed substantially simultaneously without departing from the scope of the appended claims.

It should also be understood that the illustrated method can be ended at any time. In certain embodiments, some or all steps of this process, and/or substantially equivalent steps are performed by at least one processor, such as the processor 106, executing computer-readable instructions stored or included on a computer readable medium, such as the memory 104 of the computing unit 102 shown in FIG. 1.

FIG. 4

The sub-method 400, of the method shown in FIGS. 4-6 collectively, begins and flow proceeds to block 402, whereat the vehicle—e.g., automobile—is started. It is contemplated that in some implementations of the present technology, this act 402 includes starting the performing computer—e.g., computing unit 102—and in other implementations the computing unit 102 is running before the vehicle is started.

At decision diamond 404, a computer processor, such as the processor 106 of the computing unit 102, executing computer-executable instructions, determines whether a sub-routine of, or adjunct routine for, the engine oil operating system is operating. The routine is configured to estimate an amount of fuel contaminating the engine oil of the vehicle, with consideration to the healing affect of at least occasional long-distance trips. The routine is referred to at times herein as the algorithm of the present technology, though decision 404 can also be considered a part of the algorithm.

In response to a negative result at decision 404 (i.e., the processor determines that the algorithm is not operating), flow proceeds to transfer point 405. Acts following this transfer 405 are described below in connection with FIG. 6. While transfer points (e.g., transfer 405) are shown as action blocks in FIGS. 4-6, these points can merely indicate flow between parts of the algorithm, and the processor need not actually perform an significant acts at any or all of the transfer points.

In response to a positive result at decision 404 (i.e., the processor determines that the algorithm is operating), flow proceeds to a group of acts 406, 408, 410, 412, 414. The algorithm can be configured such that any subset, or all, of these acts 406, 408, 410, 412, 414 can be performed in parallel (e.g., substantially simultaneously) or in series.

At act 406, the processor initializes a short-trip timer. In scenarios in which the processor has previously performed the algorithm up to act 436, the processor uses a value ($F_t$) derived at the most recent performance of act 436. Act 436 is described further below. The value ($F_t$) represents a total time (t) that the fuel dilution in the oil is greater than a total allowable fuel dilution in the oil ($FD_a$). The total allowable amount of fuel in the oil can be referred to as the calibration value ($FD_a$). The calibration value $FD_a$ is in some embodiments predetermined. The value $FD_a$ is in some embodiments empirically derived, such as by historical testing of oil in one or more vehicles.

At act 408, the processor resets a short-trip engine-revolutions counter (R). The processor, in resetting the short-trip rev counter (R), such as from a value the counter (R) was at from a previous performance of the algorithm or at least of this act 408, sets the short-trip rev counter (R) to start over, e.g., by setting the counter to zero (0). The short-trip rev counter can reside in the memory 104.

At act 410, the processor calculates and stores an initial oil temperature ($T_{in}$). The initial oil temperature ($T_{in}$) can be determined based on input from the engine oil temperature sensor 114 described above. The engine oil temperature can be represented in any units of temperature, such as Celsius (° C.) or Fahrenheit (° F.).

At act 412, the processor resets a long-trip timer. The processor, in resetting the long-trip timer, sets the long-trip timer to start over, e.g., by setting it to zero (0). The long-trip timer too can reside in the memory 104.

At act 414, the processor restores a value ($FD_2$) representing a total-corrected amount of fuel diluted in the oil. As shown in FIGS. 4 and 5, for implementations in which the processor previously performed the algorithm up to act 516, at act 414, the processor receives input derived at a last performance of act 516, via transfer point 517. The input includes a total-corrected amount of fuel diluted in the oil ($FD_2$) most recently stored (i.e., most-recently stored at act 516). The processor, in restoring the total-corrected amount of fuel diluted in the oil ($FD_2$), sets the value (e.g., in the memory 104) to the current value, such as that received via transfer 517.

In one embodiment, the processor, in a present iteration of the algorithm, performs act 416 after performing each of acts 406-414 in the iteration. In another embodiment, the processor continues to act 416 prior to completing one or more of the acts 406-414.

At act 416, the processor determines a value (FO) representing a cumulative amount of fuel diluted in the oil over the short-trip cycle. In one embodiment, this value (FO) is determined according to the following equation:

$$FO=FRT_{in}-[a*b*R/2]$$

wherein:

$FRT_{in}$ is, at an initial oil temperature ($T_{in}$), a fuel dilution per revolution;

R is a number of short-trip engine revolutions;

a is a slope of oil temperature as a function of engine revolutions (or ΔT/R); and b is a slope of fuel dilution per revolution as a function of oil temperature (or ΔFR/ΔT).

With reference to the example of FIG. 2, the second slope value (b) is the slope of the upper line 206.

The values for short-trip engine revolutions (R) is in some implementations empirically derived, such as by historical testing of oil in one or more vehicles. The value (R) is the number—e.g., average number from multiple empirical studies—of engine revolutions that the engine is expected to make during a short-trip cycle. In the example of FIG. 2, the short-trip cycle includes operation up to about 4 miles. The actual short-trip mileage can differ, such as being slightly or much above or below the example of 4 miles.

In an example, the value for short-trip engine revolutions (R) may be between about 1,000 and about 20,000.

At act 418, the processor calculates a value (FD) representing a total amount of fuel diluted in the oil over a short-trip cycle. As shown in FIG. 4, at act 418, the processor can receive input from a prior or simultaneous performance of act 414, the input being the restored value ($FD_2$) for total corrected amount of fuel diluted in the oil. The processor determines the value (FD) as follows:

$$FD=FO+FD_2$$

wherein FO is calculated at act 416 and the current value for $FD_2$ is determined at act 414 as described.

From act 418, flow of the algorithm proceeds to decision 420, whereat the processor determines whether the total amount of fuel diluted in the oil over a short-trip cycle (FD) is greater than the calibration value ($FD_a$), which is referenced above. In one example, the calibration value ($F_{Da}$) may be between about 2% and about 10%.

In response to a positive result at decision 420 (i.e., the total amount of fuel diluted in the oil over the short-trip cycle (FD) is greater than the calibration value ($FD_a$)), flow of the algorithm proceeds to decision 422 whereat the processor determines whether the short-trip timer is on. If not, at act 424, the timer is resumed (or started, or re-started). If the short-trip timer is determined to be turned on at decision 422, or following starting of the short-trip timer at act 422, flow proceeds to decision 426.

At decision 426, the processor determines whether a total time ($F_t$) during which the amount of fuel diluted in the vehicle oil is greater than an total allowable time ($F_{ta}$) that fuel in the oil is above an allowable concentration ($FD_a$).

The total allowable time ($F_{ta}$) fuel dilution can be above the allowable concentration ($FD_a$) is in some embodiments determined empirically, such as by historic testing of the oil in one or more vehicles. The total allowable time is set at a value so that reduced viscosity does not cause significant engine wear.

In an example, the total allowable amount of time ($F_{ta}$) that fuel dilution can be above the allowable limit ($FD_a$) is between about 0 days and about 30 days.

In response to a positive result at decision 426 (i.e., the amount of fuel diluted in the vehicle oil over the total time ($F_t$) is greater than the total allowable amount ($F_{ta}$)), flow of the algorithm proceeds to act 427. At act 427, the processor initiates provision of an alert. Providing the alert in some embodiments includes presenting the alert to a user or technician associated with the vehicle. The presentation can be made in any of a variety of ways such as via a dashboard or other light, a display, such as a touch screen display, and/or speakers of the vehicle. The alert advises the recipient that there is too much fuel in the vehicle oil—i.e., the amount of fuel diluted into the vehicle oil over the total time ($F_t$) is undesirably greater than a total amount of fuel that can be diluted into the oil, or total allowable amount ($F_{ta}$).

Following provision of the alert at block 427, flow proceeds to transition 405, described above in connection with FIG. 4, and further below in connection with FIG. 5.

In response to [A] a negative result at decision 426 (i.e., the amount of fuel diluted into the vehicle oil over the total time ($F_t$) is not greater than a total amount of fuel that can be diluted into the oil, or total allowable amount ($F_{ta}$)), or [B] a negative result at decision 420 (i.e., the total amount of fuel diluted in the oil over the short-trip cycle (FD) is not greater than the calibration value ($FD_a$)), flow of the algorithm proceeds to decision 428.

At decision 428, the processor determines whether the present oil temperature (T) is greater than a predetermined threshold value of oil temperature ($T_{th}$). In one embodiment, the oil temperature ($T_{th}$) is derived from coolant temperature, and in another embodiment from the engine oil temperature sensor 114 referenced above. As provided, the oil temperature can be represented in any units, such as Celsius (° C.) or Fahrenheit (° F.). The threshold value of oil temperature ($T_{th}$) is in some embodiments determined empirically such as by historic testing of the oil in one or more vehicles. In an example, the threshold value of oil temperature ($T_{th}$) is between about 50° C. and about 70° C.

In response to a negative result at decision 428 (i.e., the present oil temperature (T) is not greater than a threshold value of oil temperature ($T_{th}$)), flow of the algorithm returns to act 416. In response to a positive result at decision 428 (i.e., the present oil temperature (T) is greater than a threshold value of oil temperature ($T_{th}$)), flow of the algorithm proceeds to a group of acts 430, 432, 434. The algorithm can be configured so that any of these acts 430, 432, 434 are performed in parallel.

At block 430, the processor starts a long-trip timer. At block 432, the processor stops the short-trip revolutions counter (R), which was reset or started at act 408.

At block 434, the processor stops the short trip timer, which was started at act 406. Following performance of act 434, flow proceeds to act 436. At block 436, the processor stores a current value for the amount of time (Ft) that fuel dilution in the oil exceeds the allowable level, or calibration value ($F_{Da}$). In one embodiment, act 436 follows act 434 because by this point, in operating the vehicle in performing the method, the oil has warmed sufficiently so the oil is not becoming further diluted with fuel.

In one embodiment, in connection with stopping the short trip timer, the processor starts a long trip timer. For example, the long trip timer can be started at generally the same time as, or immediately after, the short trip timer is stopped. The time at which this occurs is in some embodiments determined empirically such as by historic testing of the oil in one or more vehicles. The short to long trip threshold time is set so that the oil has warmed enough for a sufficient amount of fuel to be driven out of the oil by that point. In an example, the threshold time is between about 0 minutes and about 5 minutes.

If flow of algorithm proceeds to act 514, shown in FIG. 5, the total time value stored at block 436 is the value derived from that act 514, for later use, as shown in FIGS. 4 and 5. As provided above, this stored value can be used by the processor in executing act 406 in the next iteration of the algorithm.

With continued reference to FIG. 4, in one embodiment, flow of the algorithm proceeds to the transfer point 435 following performance of one or more of the acts 430, 432, 434, and from there to FIG. 5.

FIG. 5

FIG. 5 illustrates other aspects of the method described in connection with FIGS. 4 and 6. The acts of the sub-method 500 of FIG. 5, in one embodiment, commence after the algorithm reaches transfer point 435

At act 506, the processor determines whether the vehicle engine is off. In response to a negative result at decision 506 (i.e., the engine is not turned off), the decision act 506 is re-performed. In response to a positive result at decision 506 (i.e., the engine is turned off), flow of the algorithm continues to block 508.

The long-trip time $LT_t$ is the amount of time that the vehicle has been operating in the long-trip cycle. The long-trip cycle starts in response to the vehicle reaching a transfer mileage, such as 4 miles by way of example in FIG. 3.

At act 508, the processor determines a new value for the total-corrected amount of fuel diluted in the oil ($FD_2$). For performing act 508, as shown by block 510 in FIG. 5, the processor generates, or receives input providing a rebate, which is a function ($f(LT_t)$) of the long-trip time ($LT_t$) described above. More particularly, in one embodiment, the rebate ($f(LT_t)$) is derived empirically.

The new value for the total-corrected amount of fuel diluted in the oil ($FD_2$) is in one embodiment calculated according to the following equation:

$$FD_2 = FD + \text{rebate}.$$

At decision 512, the processor determines whether the new value for the total-corrected amount of fuel diluted in the oil ($FD_2$) is less than the total amount of fuel diluted in the oil over the short-trip cycle (FD).

In response to a positive result at decision 512 (i.e., the new value for the total-corrected amount of fuel diluted in the oil ($FD_2$) is less than the total amount of fuel diluted in the oil over the short-trip cycle (FD)), flow of the algorithm continues to block 514. At act 514, the processor resets the short-trip timer, which was initialized at act 406 and stopped at act 434.

Following act 514, or in response to a negative result at decision 512 (i.e., the new value for the total-corrected amount of fuel diluted in the oil ($FD_2$) is not less than the total amount of fuel diluted in the oil over the short-trip cycle (FD)), flow proceeds to act 516. At act 516, the processor stores the new, or current, value for the total-corrected amount of fuel diluted in the oil ($FD_2$). The new value ($FD_2$), as last stored at act 516, can be used by the processor in act 414 of the next iteration of the algorithm, as provided above and indicated by transfer point 517.

As further shown in FIG. 5, following resetting of the short-trip timer at act 514, the algorithm also proceeds to transfer point 515. Via transfer 515, a new, or current, amount of fuel diluted into the vehicle oil over the total time ($F_e$) is stored at act 436. As provided above, this value can be used by the processor in a next iteration of the algorithm.

Following act 516, flow of the algorithm continues to act 518. At block 518, the processor checks a level of a vehicle oil system sump. Act 518 is performed in order to see if the oil sump is overfull. From block 518, or from transfer 405, described above in connection with FIG. 4, flow proceeds to block 520 of FIG. 5. At block 520, the processor accesses the engine oil life system of the vehicle. For embodiments of the present technology in which computer-executable instructions, for performing the present algorithm up to this point, are a part of the engine oil life system, then act 520 includes the processor accessing a portion of the engine oil life system other than the present algorithm.

From block 520, flow proceeds to transfer point 521, as shown in FIG. 5. Acts following this transfer point 521 are described below in connection with FIG. 6.

FIG. 6

FIG. 6 illustrates additional aspects of the method described in connection with FIGS. 4 and 5. The acts of the sub-method 600 of FIG. 6 in one embodiment commence after the algorithm reaches transfer point 521. Following the transfer 521, the processor at decision 602 determines whether the engine oil life system has been reset.

In response to a negative result at decision 602 (i.e., the engine oil system has not been reset), flow of the algorithm returns to block 520, from there back to transfer 521, and then back to decision 602.

In response to a positive result at decision 602 (i.e., the engine oil system has been reset), flow of the algorithm proceeds to two acts 604, 606. The algorithm can be configures so that these acts 604, 606 can be performed in parallel (e.g., substantially simultaneously) or in series.

At block 604, the processor resets the amount of fuel diluted in the vehicle oil over the total time ($F_t$) to zero (0). The algorithm resets the amount of fuel diluted in the vehicle oil over the total time ($F_t$) to zero (0) because the oil has been changed.

At block 606, the processor also resets the total-corrected amount of fuel diluted in the oil ($FD_2$) to zero (0). The algorithm resets total-corrected amount of fuel diluted in the oil ($FD_2$) to zero (0) because an oil change has occurred.

Following performance of blocks 606 and 608, the method of FIGS. 4-6 can end or be re-performed, such as by returning to act 404 of FIG. 4.

Healing Effect on Oil Via Reduced Water Contamination

FIG. 7

Figure 7:
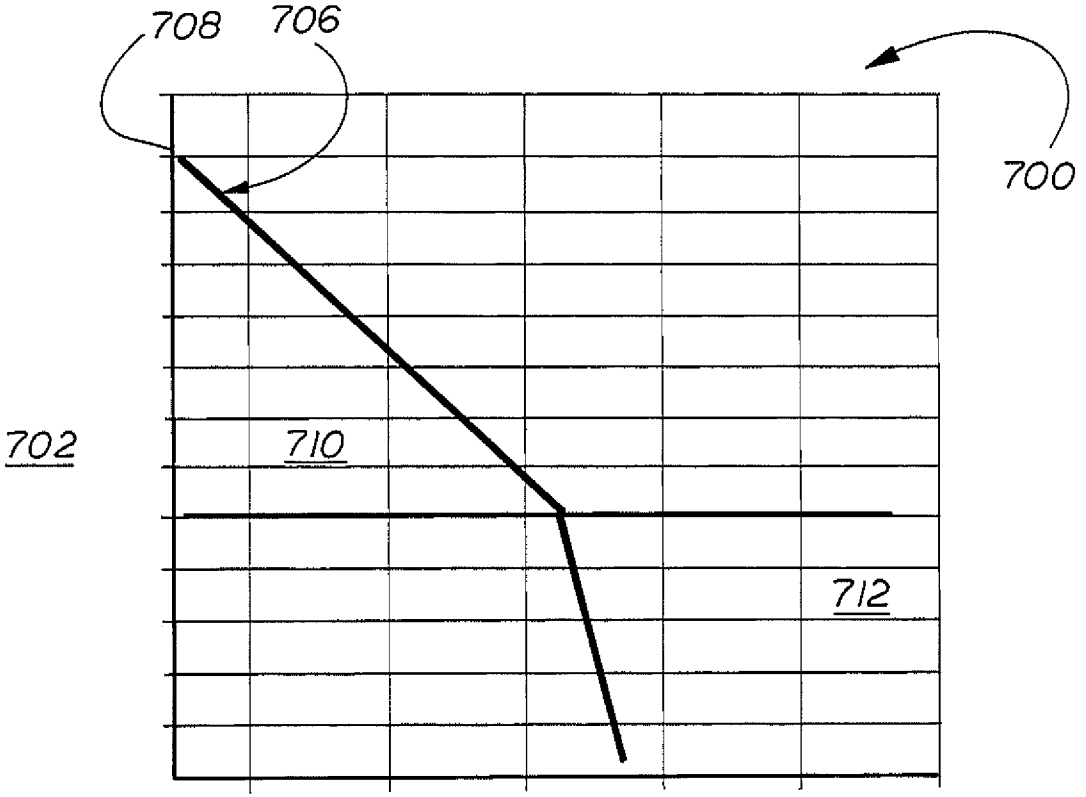
FIG. 7 illustrates a chart showing water dilution per revolution as a function of oil temperature, according to one example.

With continued reference to the figures, FIG. 7 illustrates a chart 700 showing water dilution per revolution (WR) 702 (or rate of water dilution) as a function of oil temperature 704, according to one example. Exemplary actual values for water dilution per revolution (WR) 706 are shown.

In the illustrated embodiment, the actual value for water dilution per revolution (WR) is highest at a start of vehicle operation ($WR_{initial}$, or $WR_{max.}$), when the temperature is lowest ($T_{initial}$, or $T_{min.}$). In one embodiment, as shown in FIG. 7, the water dilution per revolution decreases in generally a linear manner with increase in temperature, such as from the initial, or maximum, water dilution per revolution ($WR_{initial}$, or $T_{max.}$) to a final or minimum water dilution per revolution ($WR_{final}$, or $T_{min.}$).

The chart 700 also illustrates a transition point 708, corresponding to a transition oil temperature (T) 704. Below the transition temperature, water is generally being added to the oil during vehicle operation, and above the transition temperature, water is generally being evaporated from the oil during operation.

FIG. 8

Figure 8:
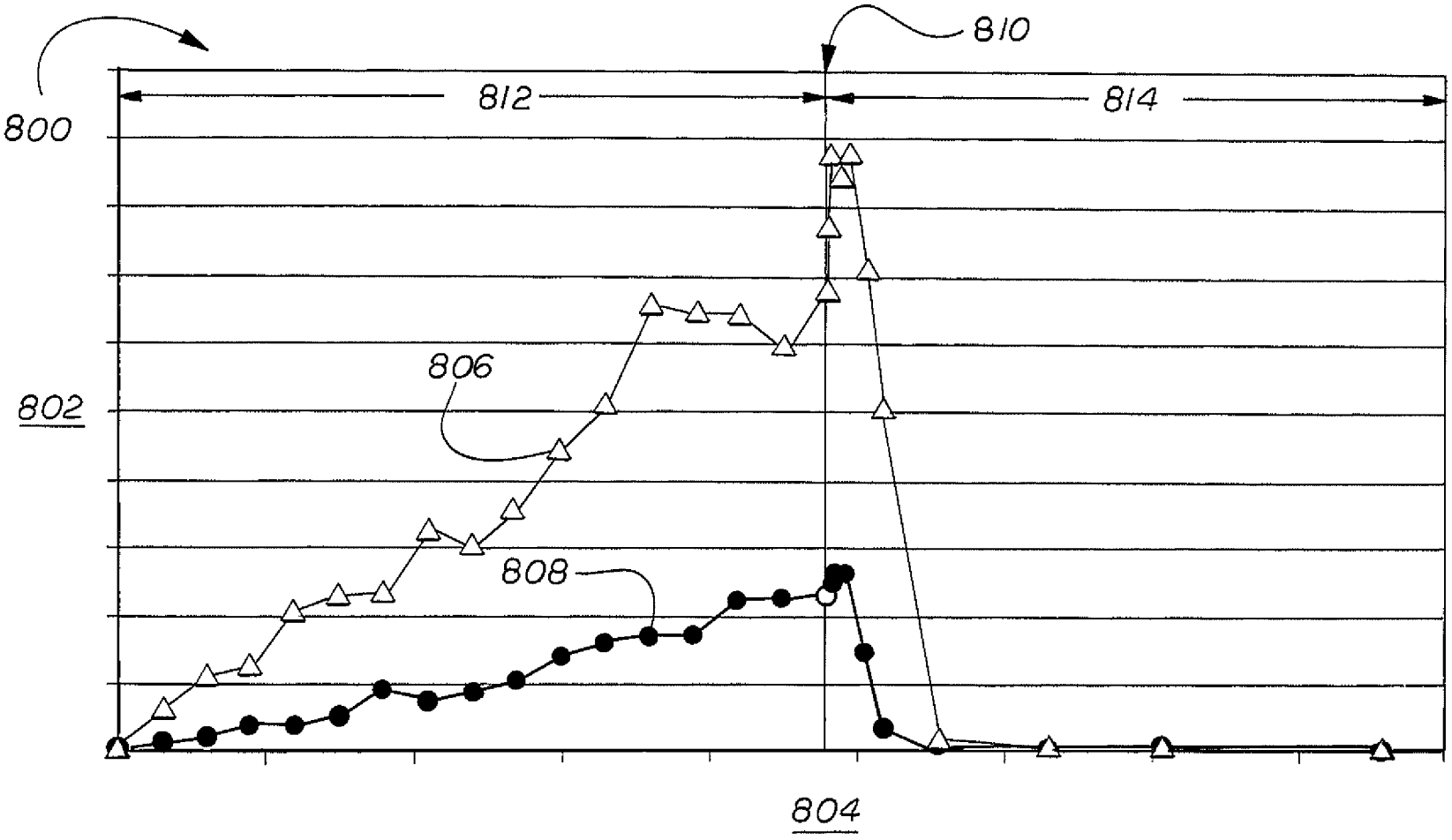
FIG. 8 illustrates a chart showing a percentage of water weight in an oil sample as a function of miles driven, according to one example.

FIG. 8 illustrates a chart 800 showing a percentage of water weight 802 in an oil sample as a function of miles 804 driven by a vehicle in cooler (e.g., winter time of year) temperatures 806, and in warmer (e.g., spring) temperatures 808. As shown in the chart 800, when used in the cooler temperatures, the oil has higher percentages of water weight as compared to the oil when the vehicle is operating in the warmer ambient environment. Operation up to a certain, transition mileage 910 (e.g., about 4 miles in one embodiment) can be referred to as a short-trip driving cycle 812, and above that mileage 810, a long-trip, or highway driving cycle 814.

As shown in the figure, in the short-trip driving cycle 812, the percentage of water weight 802, for both cooler and warmer-environment driving, generally increases with the number of short trips. Following the transition mileage 810, the percentage of water weight 802 generally decreases as vehicle enters and continues operating in the long-trip cycle 814.

Figure 9:
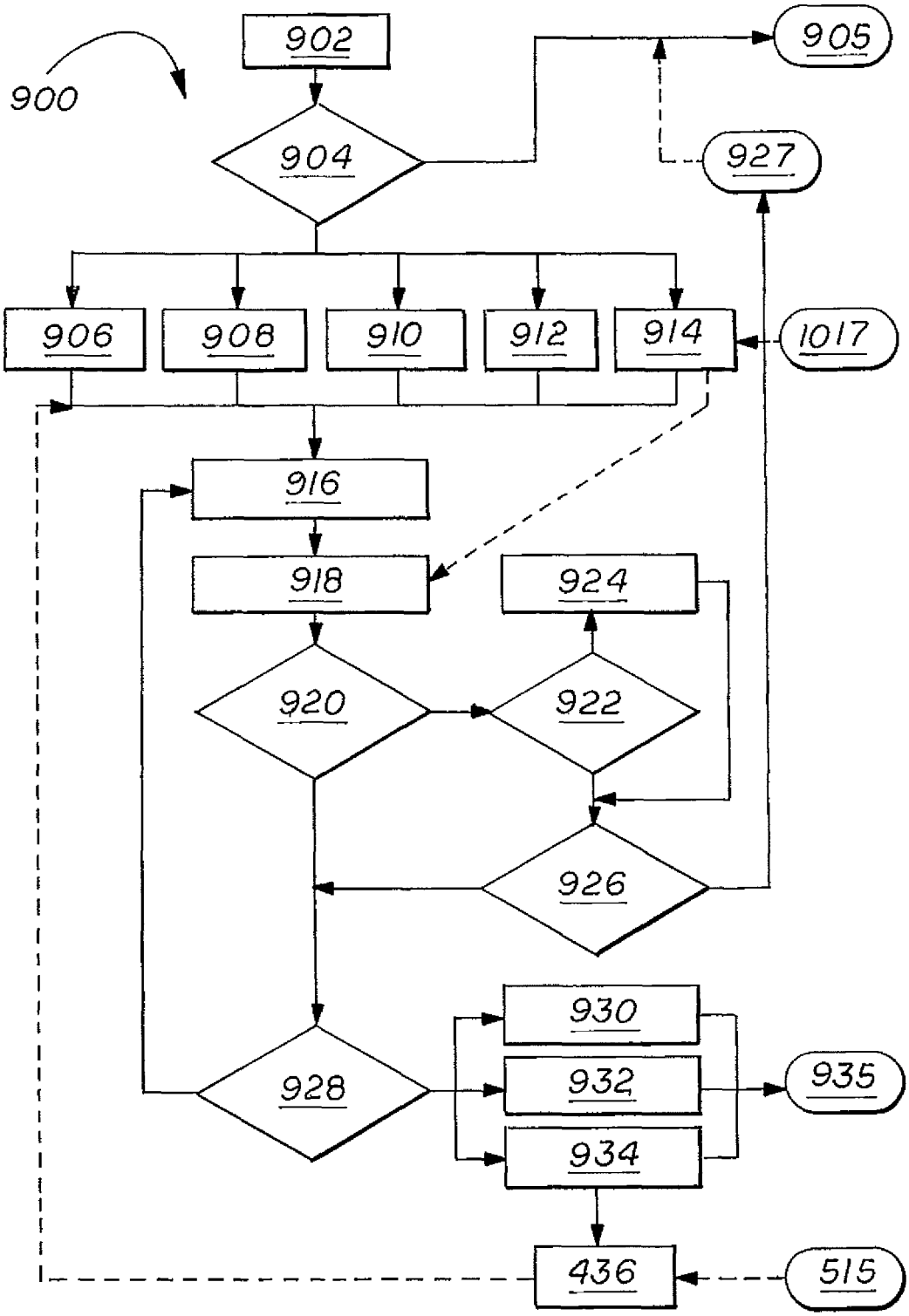
FIG. 9 illustrates initial aspects of a method for estimating degradation of engine oil, with consideration given to water dilution of the oil and the healing effect of occasional longer trips.
Figure 10:
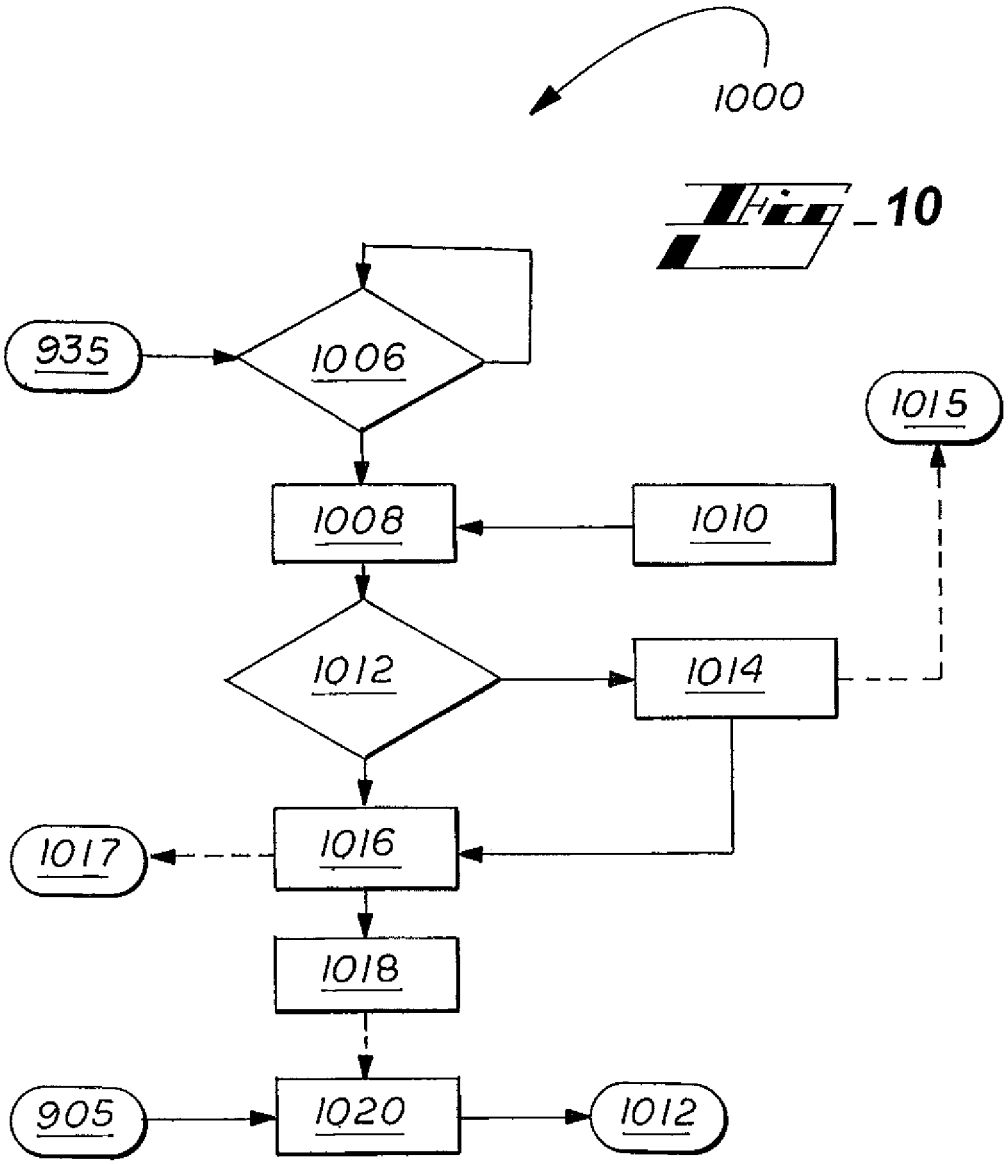
FIG. 10 illustrates other aspects of the method described in connection with FIGS. 9 and 11.
Figure 11:
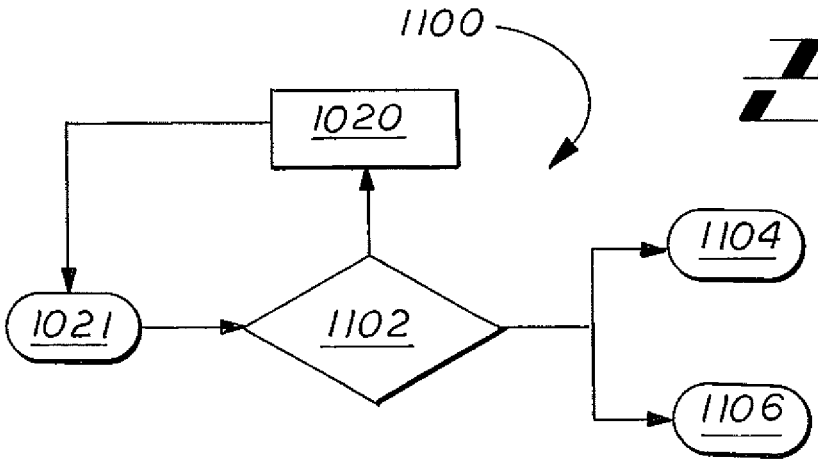
FIG. 11 illustrates additional aspects of the method described in connection with FIGS. 9 and 10.

Introduction to FIGS. 9-11

FIGS. 9-11 illustrate schematically an exemplary method for estimating degradation of engine oil, with consideration to water dilution of the oil and a healing effect of at least occasional long-trip driving. Each figure of FIGS. 9-11 can be considered to show a sub-method (sub-methods 900, 1000, 1100) of the overall method shown by the figures taken together.

Further, as provided above the algorithm described above in connection with FIGS. 4-6 regarding fuel dilution can be combined to any desired extent with the algorithm described herein regarding FIGS. 9-11 regarding water, and to any extent that the algorithms are separate, they can be performed together or separately as desired by a designer of the system. As further provided, in one aspect of the present technology, the algorithm described above in connection with accounting for the healing effect that longer trips have by vaporization of unwanted fuel can be used in the vehicle at same time that the present algorithm accounting for the healing effect that longer trips have by evaporating of unwanted water. And in one aspect of the present technology, a single algorithm incorporates some or all aspects of both of the separately described algorithms. And one or more of any features or functions common between the algorithms can be shared.

The steps of the method shown by FIGS. 9-11 described herein are not necessarily presented in any particular order and that performance of some or all the steps in an alternative order is possible and is contemplated. The steps have been presented in the demonstrated order for ease of description and illustration. Steps can be added, omitted and/or performed substantially simultaneously without departing from the scope of the appended claims.

It should also be understood that the illustrated method can be ended at any time. In certain embodiments, some or all steps of this process, and/or substantially equivalent steps are performed by at least one processor, such as the processor 106, executing computer-readable instructions stored or included on a computer readable medium, such as the memory 104 of the computing unit 102 shown in FIG. 1.

FIG. 9

The sub-method 900, of the method shown in FIGS. 9-11 collectively, begins and flow proceeds to block 902, whereat the vehicle—e.g., automobile—is started. It is contemplated that in some implementations of the present technology, this act 902 includes starting the performing computer e.g., computing unit 102—and in other implementations the computing unit 102 is running before the vehicle is started.

At decision diamond 904, a computer processor, such as the processor 106 of the computing unit 102, executing computer-executable instructions, determines whether a sub-routine of, or adjunct routine for, the engine oil operating system is operating. The routine is configured to estimate an amount of water contaminating the engine oil of the vehicle, with consideration to the healing affect of at least occasional long-distance trips. The routine is referred to at times herein as the algorithm of the present technology, though decision 904 can also be considered a part of the algorithm.

In response to a negative result at decision 904 (i.e., the processor determines that the algorithm is not operating), flow proceeds to transfer point 905. Acts following this transfer 905 are described below in connection with FIG. 11. While transfer points (e.g., transfer 905) are shown as action blocks in FIGS. 9-11, these points can merely indicate flow between parts of the algorithm, and the processor need not actually perform an significant acts at any or all of the transfer points.

In response to a positive result at decision 904 (i.e., the processor determines that the algorithm is operating), flow proceeds to a group of acts 906, 908, 910, 912, 914. The algorithm can be configured such that any subset, or all, of these acts 906, 908, 910, 912, 914 can be performed in parallel (e.g., substantially simultaneously) or in series.

At act 906, the processor initializes a short-trip timer. In scenarios in which the processor has previously performed the algorithm up to act 936, the processor uses a value ($W_t$) derived at the most recent performance of act 936. Act 936 is described further below. The value ($W_t$) represents a total time (t) that the water dilution in the oil is greater than a total allowable water dilution in the oil ($WD_a$). The total allowable amount of water in the oil can be referred to as the calibration value ($WD_a$). The calibration value $WD_a$ is in some embodiments predetermined. The value $WD_a$ is in some embodiments empirically derived, such as by historical testing of oil in one or more vehicles.

At act 908, the processor resets a short-trip engine-revolutions counter (R). The processor, in resetting the short-trip rev counter (R), such as from a value the counter (R) was at from a previous performance of the algorithm or at least of this act 908, sets the short-trip rev counter (R) to start over, e.g., by setting the counter to zero (0). The short-trip rev counter can reside in the memory 104.

At act 910, the processor calculates and stores an initial oil temperature ($T_{in}$). The initial oil temperature ($T_{in}$) can be determined based on input from the engine oil temperature sensor 114 described above. The engine oil temperature can be represented in any units of temperature, such as Celsius (° C.) or Fahrenheit (° F.).

At act 912, the processor resets a long-trip timer. The processor, in resetting the long-trip timer, sets the long-trip timer to start over, e.g., by setting it to zero (0). The long-trip timer too can reside in the memory 104.

At act 914, the processor restores a value ($WD_2$) representing a total-corrected amount of water diluted in the oil. As shown in FIGS. 9 and 10, for implementations in which the processor previously performed the algorithm up to act 1016, at act 914, the processor receives input derived at a last performance of act 1016, via transfer point 1017. The input includes a total-corrected amount of water diluted in the oil ($WD_2$) most recently stored (i.e., most-recently stored at act 1016). The processor, in restoring the total-corrected amount of water diluted in the oil ($WD_2$), sets the value (e.g., in the memory 104) to the current value, such as that received via transfer 1017.

In one embodiment, the processor, in a present iteration of the algorithm, performs act 916 after performing each of acts 906-914 in the iteration. In another embodiment, the processor continues to act 916 prior to completing one or more of the acts 906-914.

At act 916, the processor determines a value (WO) representing a cumulative amount of water diluted in the oil over the short-trip cycle. In one embodiment, this value (WO) is determined according to the following equation:

$$WO=WRT_{in}-[a*b*R/2]$$

wherein:

$WRT_{in}$ is, at an initial oil temperature ($T_{in}$), a water dilution per revolution;

R is a number of short-trip engine revolutions;

a is a slope of oil temperature as a function of engine revolutions (or $\Delta T/R$); and b is a slope of water dilution per revolution as a function of oil temperature (or $\Delta WR/\Delta T$).

With reference to the example of FIG. 7, the second slope value (b) is the slope of the upper line 706.

The values for short-trip engine revolutions (R) is in some implementations empirically derived, such as by historical testing of oil in one or more vehicles. The value (R) is the number—e.g., average number from multiple empirical studies—of engine revolutions that the engine is expected to make during a short-trip cycle. In the example of FIG. 7, the short-trip cycle includes operation up to about 4 miles. The actual short-trip mileage can differ, such as being slightly or much above or below the example of 4 miles.

In an example, the value for short-trip engine revolutions (R) may be between about 1,000 and about 20,000.

At act 918, the processor calculates a value (WD) representing a total amount of water diluted in the oil over a short-trip cycle. As shown in FIG. 9, at act 918, the processor can receive input from a prior or simultaneous performance of act 914, the input being the restored value ($WD_2$) for total corrected amount of water diluted in the oil. The processor determines the value (WD) as follows:

$$WD=WO+WD_2$$

wherein WO is calculated at act 916 and the current value for $WD_2$ is determined at act 914 as described.

From act 918, flow of the algorithm proceeds to decision 920, whereat the processor determines whether the total amount of water diluted in the oil over a short-trip cycle (WD) is greater than the calibration value ($WD_a$), which is referenced above. In one example, the calibration value ($W_{Da}$) may be between about 2% and about 10%.

In response to a positive result at decision 920 (i.e., the total amount of water diluted in the oil over the short-trip cycle (WD) is greater than the calibration value ($WD_a$)), flow of the algorithm proceeds to decision 922 whereat the processor determines whether the short-trip timer is on. If not, at act 924, the timer is resumed (or started, or re-started). If the short-trip timer is determined to be turned on at decision 922, or following starting of the short-trip timer at act 922, flow proceeds to decision 926.

At decision 926, the processor determines whether a total time ($W_t$) during which the amount of water diluted in the vehicle oil is greater than an total allowable time ($W_{ta}$) that water in the oil is above an allowable concentration ($WD_a$).

The total allowable time ($W_{ta}$) water dilution can be above the allowable concentration ($WD_a$) is in some embodiments determined empirically, such as by historic testing of the oil in one or more vehicles. The total allowable time is set at a value so that reduced viscosity does not cause significant engine wear.

In an example, the total allowable amount of time ($W_{ta}$) that water dilution can be above the allowable limit ($WD_a$) is between about 0 days and about 30 days.

In response to a positive result at decision 926 (i.e., the amount of water diluted in the vehicle oil over the total time ($W_t$) is greater than the total allowable amount ($W_{ta}$)), flow of the algorithm proceeds to act 927. At act 927, the processor initiates provision of an alert. Providing the alert in some embodiments includes presenting the alert to a user or technician associated with the vehicle. The presentation can be made in any of a variety of ways such as via a dashboard or other light, a display, such as a touch screen display, and/or speakers of the vehicle. The alert advises the recipient that there is too much water in the vehicle oil—i.e., the amount of water diluted into the vehicle oil over the total time ($W_e$) is undesirably greater than a total amount of water that can be diluted into the oil, or total allowable amount ($W_{ta}$).

Following provision of the alert at block 927, flow proceeds to transition 905, described above in connection with FIG. 9, and further below in connection with FIG. 10.

In response to [A] a negative result at decision 926 (i.e., the amount of water diluted into the vehicle oil over the total time ($W_t$) is not greater than a total amount of water that can be diluted into the oil, or total allowable amount ($W_{ta}$)), or [B] a negative result at decision 920 (i.e., the total amount of water diluted in the oil over the short-trip cycle (WD) is not greater than the calibration value ($WD_a$)), flow of the algorithm proceeds to decision 928.

At decision 928, the processor determines whether the present oil temperature (T) is greater than a predetermined threshold value of oil temperature ($T_{th}$). In one embodiment, the oil temperature ($T_{th}$) is derived from coolant temperature, and in another embodiment from the engine oil temperature sensor 114 referenced above. As provided, the oil temperature can be represented in any units, such as Celsius (° C.) or Fahrenheit (° F.). The threshold value of oil temperature ($T_{th}$) is in some embodiments determined empirically such as by historic testing of the oil in one or more vehicles. In an example, the threshold value of oil temperature ($T_{th}$) is between about 50° C. and about 70° C.

In response to a negative result at decision 928 (i.e., the present oil temperature (T) is not greater than a threshold value of oil temperature ($T_{th}$)), flow of the algorithm returns to act 916. In response to a positive result at decision 928 (i.e., the present oil temperature (T) is greater than a threshold value of oil temperature ($T_{th}$)), flow of the algorithm proceeds to a group of acts 930, 932, 934. The algorithm can be configured so that any of these acts 930, 932, 934 are performed in parallel.

At block 930, the processor starts a long-trip timer. At block 932, the processor stops the short-trip revolutions counter (R), which was reset or started at act 908.

At block 934, the processor stops the short trip timer, which was started at act 906. In one embodiment, in the processor in this operation also starts a long-trip timer.

In one embodiment, in connection with stopping the short trip timer, the processor starts a long trip tinier. For example, the long trip timer can be started at generally the same time as, or immediately after, the short trip timer is stopped. The time at which this occurs is in some embodiments determined empirically such as by historic testing of the oil in one or more vehicles. The short to long trip threshold time is set so that the oil has warmed enough for a sufficient amount of water to be driven out of the oil by that point. In an example, the threshold time is between about 0 minutes and about 5 minutes.

Following performance of act 934, flow proceeds to act 936. At block 936, the processor stores a current value for the amount of time (Wt) that water dilution in the oil exceeds the allowable level, or calibration value ($WD_a$). In one embodiment, act 936 follows act 934 because by this point, in operating the vehicle in performing the method, the oil has warmed sufficiently so the oil is not becoming further diluted with water.

If flow of algorithm proceeds to act 1014, shown in FIG. 10, the total time value stored at block 936 is the value derived from that act 1014, as shown in FIGS. 9 and 10. As provided above, this stored value can be used in the next iteration of the algorithm.

With continued reference to FIG. 9, in one embodiment, flow of the algorithm proceeds to the transfer point 935 following performance of one or more of the acts 930, 932, 934, and from there to FIG. 10.

FIG. 10

FIG. 10 illustrates other aspects of the method described in connection with FIGS. 9 and 11. The acts of the sub-method 1000 of FIG. 10, in one embodiment, commence after the algorithm reaches transfer point 935.

At act 1006, the processor determines whether the vehicle engine is off. In response to a negative result at decision 1006 (i.e., the engine is not turned off), the decision act 1006 is re-performed. In response to a positive result at decision 1006 (i.e., the engine is turned off), flow of the algorithm continues to block 1008.

The long-trip time $LT_t$ is the amount of time that the vehicle has been operating in the long-trip cycle. The long-trip cycle starts in response to the vehicle reaching a transfer mileage, such as 4 miles by way of example in FIG. 3.

The transition between short trip and long trip is in some embodiments determined empirically such as by historic testing of the oil in one or more vehicles. The long-trip start time is set so that the oil has warmed sufficiently so that a sufficient amount of water is being driven out of the oil at that point. In an example, the long-trip threshold time is between about 0 minutes and about 5 minutes.

At act 1008, the processor determines a new value for the total-corrected amount of water diluted in the oil ($WD_2$). For performing act 1008, as shown by block 1010 in FIG. 10, the processor generates, or receives input providing a rebate, which is a function ($f(LT_t)$) of the long-trip time ($LT_t$) described above. More particularly, in one embodiment, the rebate ($f(LT_t)$) is derived empirically.

The new value for the total-corrected amount of water diluted in the oil ($WD_2$) is in one embodiment calculated according to the following equation:

$$WD_2 = WD + \text{rebate}.$$

At decision 1012, the processor determines whether the new value for the total-corrected amount of water diluted in the oil ($WD_2$) is less than the total amount of water diluted in the oil over the short-trip cycle (WD).

In response to a positive result at decision 1012 (i.e., the new value for the total-corrected amount of water diluted in the oil ($WD_2$) is less than the total amount of water diluted in the oil over the short-trip cycle (WD)), flow of the algorithm continues to block 1014. At act 1014, the processor resets the short-trip timer, which was initialized at act 906 and stopped at act 934.

Following act 1014, or in response to a negative result at decision 1012 (i.e., the new value for the total-corrected amount of water diluted in the oil ($WD_2$) is not less than the total amount of water diluted in the oil over the short-trip cycle (WD)), flow proceeds to act 1016. At act 1016, the processor stores the new, or current, value for the total-corrected amount of water diluted in the oil ($WD_2$). The new value ($WD_2$), as last stored at act 1016, can be used by the processor in act 914 of the next iteration of the algorithm, as provided above and indicated by transfer point 1017.

As further shown in FIG. 10, following resetting of the short-trip timer at act 1014, the algorithm also proceeds to transfer point 1015. Via transfer 1015, a new, or current, amount of water diluted into the vehicle oil over the total time ($W_e$) is stored at act 936. As provided above, this value can be used by the processor in act 906 of the next iteration of the algorithm.

Following act 1016, flow of the algorithm continues to act 1018. At block 1018, the processor checks a level of a vehicle oil system sump. Act 1018 is performed in order to see if the oil sump is overfull. From block 1018, or from transfer 905, described above in connection with FIG. 9, flow proceeds to block 1020 of FIG. 10. At block 1020, the processor accesses the engine oil life system of the vehicle. For embodiments of the present technology in which computer-executable instructions, for performing the present algorithm up to this point, are a part of the engine oil life system, then act 1020 includes the processor accessing a portion of the engine oil life system other than the present algorithm.

From block 1020, flow proceeds to transfer point 1021, as shown in FIG. 10. Acts following this transfer point 1021 are described below in connection with FIG. 11.

FIG. 11

FIG. 11 illustrates additional aspects of the method described in connection with FIGS. 9 and 10. The acts of the sub-method 1100 of FIG. 11 in one embodiment commence after the algorithm reaches transfer point 1021. Following the transfer 1021, the processor at decision 1102 determines whether the engine oil life system has been reset.

In response to a negative result at decision 1102 (i.e., the engine oil system has not been reset), flow of the algorithm returns to block 1020, from there back to transfer 1021, and then back to decision 1102.

In response to a positive result at decision 1102 (i.e., the engine oil system has been reset), flow of the algorithm proceeds to two acts 1104, 1106. The algorithm can be configures so that these acts 1104, 1106 can be performed in parallel (e.g., substantially simultaneously) or in series.

At block 1104, the processor resets the amount of water diluted in the vehicle oil over the total time ($W_t$) to zero (0). The algorithm resets the amount of water diluted in the vehicle oil over the total time ($W_t$) to zero (0) because the oil has been changed.

At block 1106, the processor also resets the total-corrected amount of water diluted in the oil ($WD_2$) to zero (0). The algorithm resets total-corrected amount of water diluted in the oil ($WD_2$) to zero (0) because an oil change has occurred.

Following performance of blocks 1106 and 1108, the method of FIGS. 9-11 can end or be re-performed, such as by returning to act 904 of FIG. 9.

CONCLUSION

Various embodiments of the present disclosure are disclosed herein. The disclosed embodiments are merely examples that may be embodied in various and alternative forms, and combinations thereof. For instance, methods performed by the present technology are not limited to the methods 400, 500, 600, 900, 1000, and 1100 described above in connection with FIGS. 4-6 and 9-11.

The law does not require and it is economically prohibitive to illustrate and teach every possible embodiment of the present claims. Hence, the above-described embodiments are merely exemplary illustrations of implementations set forth for a clear understanding of the principles of the disclosure. Variations, modifications, and combinations may be made to the above-described embodiments without departing from the scope of the claims. All such variations, modifications, and combinations are included herein by the scope of this disclosure and the following claims.

What is claimed is:

1. A system, configured to monitor vehicle engine oil contaminants using output of a vehicle sensor, comprising:

a hardware-based processing device configured to perform operations comprising:

determining a time cycle indicative of a duration during which the vehicle has been in operation;

receiving output from the vehicle sensor indicative of a temperature of the engine oil;

determining, based the output of the vehicle sensor, a temperature of the engine oil;

determining whether the temperature of the engine oil is greater than a threshold; and generating, in response to determining that the temperature of the engine oil is greater than the threshold temperature, a correction factor indicative of an amount of contaminant removed from the engine oil during the time cycle.

2. The system of claim 1, wherein the correction factor is indicative of an amount of extraneous fluid dissipated from the engine oil during the time cycle.

3. The system of claim 2, wherein the extraneous fluid includes at least one fluid selected from a group consisting of fuel and water.

4. The system of claim 1, wherein the processing device is further configured to determine a corrected contaminant dilution value based on an initial contaminant dilution value and the correction factor.

5. The system of claim 4, wherein:

the correction factor is indicative of an amount of extraneous fluid dissipated from the engine oil during the time cycle; and the extraneous fluid includes at least one fluid selected from a group consisting of water and fuel.

6. The system of claim 4, wherein the corrected contaminant dilution value is a sum of the correction factor and the initial contaminant dilution value.

7. The system of claim 1, wherein the processing device is further configured to:

determine whether a total amount of extraneous fluid diluted in the engine oil is greater than a calibration value; and determine whether the temperature of the engine oil is greater than the threshold temperature in response to determining that the total amount of extraneous fluid is not greater than the calibration value.

8. The system of claim 7, wherein the processing device is further configured to determine the total amount of extraneous fluid based on a cumulative amount of extraneous fluid diluted into the engine oil.

9. The system of claim 7, wherein the cumulative amount of extraneous fluid is based on a level of extraneous fluid dilution per revolution at an initial engine oil temperature, a rate of change of engine oil temperature as a function of engine revolutions, and a rate of change of extraneous fluid dilution as a function of temperature.

10. The system of claim 1, further comprising the vehicle sensor.

11. A method, for implementation by a system comprising a vehicle sensor and a hardware-based processing device configured to monitor vehicle engine oil contaminants using output of the vehicle sensor, the method comprising:

determining, by the system, a time cycle indicative of a duration during which the vehicle has been in operation;

receiving, from the vehicle sensor, output indicative of a temperature of the engine oil;

determining, by the system, based the output of the vehicle sensor, a temperature of the engine oil;

determining, by the system, whether the temperature of the engine oil is greater than a threshold; and generating, by the system, in response to determining that the temperature of the engine oil is greater than the threshold temperature, a correction factor indicative of an amount of contaminant removed from the engine oil during the time cycle.

12. The method of claim 11, wherein the correction factor is indicative of an amount of extraneous fluid dissipated from the engine oil during the time cycle.

13. The method of claim 12, wherein the extraneous fluid includes at least one fluid selected from a group consisting of fuel and water.

14. The method of claim 11, further comprising determining, by the system, a corrected contaminant dilution value based on an initial contaminant dilution value and the correction factor.

15. The method of claim 14, wherein:

the correction factor is indicative of an amount of extraneous fluid dissipated from the engine oil during the time cycle; and the extraneous fluid includes at least one fluid selected from a group consisting of fuel and water.

16. The method of claim 11, further comprising determining, by the system, a total amount of extraneous fluid based on a cumulative amount of extraneous fluid diluted into the engine oil.

17. The method of claim 16, further comprising:

determining, by the system, whether the total amount of extraneous fluid diluted in the engine oil is greater than a calibration value; and determining, by the system, whether the temperature of the engine oil is greater than the threshold temperature in response to determining that the total amount is not greater than the calibration value.

18. The method of claim 16, wherein the cumulative amount of extraneous fluid is based on a level of extraneous fluid dilution per revolution at an initial engine oil temperature, a rate of change of engine oil temperature as a function of engine revolutions, and a rate of change of extraneous fluid dilution as a function of temperature.

19. The method of claim 11, wherein the system comprises the vehicle sensor.

20. A non-transitory storage device configured for use with a system for monitoring contaminants of vehicle engine oil using output of a vehicle sensor, the non-transitory storage device comprising instructions that, when executed by a processor of the system, cause the processor to perform operations comprising:

determining a time cycle indicative of a duration during which the vehicle has been in operation;

receiving, from the vehicle sensor, output indicative of a temperature of the engine oil;

determining, based on the output of the vehicle sensor, whether the temperature of the engine oil is greater than a threshold; and generating, in response to determining that the temperature of the engine oil is greater than the threshold temperature, a correction factor indicative of an amount of contaminant removed from the engine oil during the time cycle.

* * * * *